US009784055B1

(12) United States Patent
Bair et al.

(10) Patent No.: US 9,784,055 B1
(45) Date of Patent: Oct. 10, 2017

(54) POLISH ROD ALIGNMENT DEVICE/STUFFING BOX PACKING PRESERVER

(71) Applicant: Black Gold Pump and Supply, Inc., Signal Hill, CA (US)

(72) Inventors: Michael Bair, Los Angeles, CA (US); Scott Sakakura, Los Angeles, CA (US)

(73) Assignee: Black Gold Pump and Supply, Inc., Signal Hill, CA (US)

( * ) Notice: Subject to any disclaimer, the term of this patent is extended or adjusted under 35 U.S.C. 154(b) by 169 days.

(21) Appl. No.: 14/596,158

(22) Filed: Jan. 13, 2015

Related U.S. Application Data

(60) Provisional application No. 61/926,832, filed on Jan. 13, 2014.

(51) Int. Cl.
*E21B 19/24* (2006.01)
*E21B 17/00* (2006.01)
*E21B 17/10* (2006.01)

(52) U.S. Cl.
CPC ..... *E21B 19/24* (2013.01); *E21B 17/006* (2013.01); *E21B 17/1071* (2013.01)

(58) Field of Classification Search
None
See application file for complete search history.

(56) References Cited

U.S. PATENT DOCUMENTS 4,694,910 A * 9/1987 Towner ..... F16J 15/56 166/379
5,058,668 A * 10/1991 Newton ..... E21B 33/08 166/170
5,137,083 A * 8/1992 Bump ..... E21B 33/072 166/80.1
5,398,944 A * 3/1995 D'Alfonso ..... E21B 33/08 166/84.2
2003/0127220 A1* 7/2003 Farquharson ..... E21B 33/08 166/86.3
2003/0184019 A1* 10/2003 Rimmer ..... E21B 33/03 277/323
2012/0132432 A1* 5/2012 Carbaugh ..... E21B 17/085 166/345
2013/0269927 A1* 10/2013 Woods ..... E21B 33/08 166/84.2

* cited by examiner

*Primary Examiner* — Waseem Moorad
*Assistant Examiner* — Kenneth Beyers
(74) *Attorney, Agent, or Firm* — James M. Duncan, Esq.; Klein DeNatale Goldner

(57) ABSTRACT

A polish rod alignment and stabilization device preserves stuffing box packing and protects the polish rod of an oil well sucker rod string by guiding and aligning the polish rod as it reciprocates within the stuffing box thereby reducing lateral motion of the polish rod reciprocates up and down. Embodiments of the invention may also wipe the polish rod of debris as it reciprocates within the device. The alignment device utilizes a rod centralizer to which a stuffing box is made up. The centralizer has a second end to which an alignment barrel depends, either by direct connection or by utilization of a barrel adapter. The alignment barrel is disposed within the uppermost portion of the tubing string of the well.

11 Claims, 13 Drawing Sheets

POLISH ROD ALIGNMENT DEVICE/STUFFING BOX PACKING PRESERVER

RELATED APPLICATIONS

U.S. Application No. 61/926,832 for this invention was filed on Jan. 13, 2014, for which application these inventors claim domestic priority, and which application is incorporated in its entirety.

BACKGROUND OF THE INVENTION

The present invention generally relates to artificial lift systems which are utilized for production of fluids from subsurface reservoirs, including oil, water, and liquid phase hydrocarbons. More particularly, the present invention is utilized with artificial lift systems where a subsurface pump is actuated by a plurality of rods connected end-to-end, herein collectively referred to as a "rod string." The rod string is set within a plurality of tubing joints likewise connected end-to-end, wherein the tubing joints are collectively referred to as a "tubing string." Actuation of the subsurface pump lifts the fluid upwardly from the subsurface pump to the surface, where the fluids flow in the annular space between the rod string and the inside diameter of the tubing string as the fluid flows upwardly.

The typical subsurface pump operated by a rod string is a positive displacement pump operated by reciprocation of the rod string. This type of pump has a plunger connected to the rod string, where the plunger reciprocates within a polished barrel located at the bottom of the tubing string such that liquids are drawn into the pump barrel and lifted upwardly through the tubing string. The reciprocating motion of the rod string is typically imparted by a pump jack.

For this system, the uppermost rod in the rod string is a polish rod. The polish rod reciprocates in and out of a stuffing box. The stuffing box is a close-fit assembly which cleans the polished rod, prevents debris from entering or exiting the well, and further prevents fluid from leaking from the well during operation. The stuffing box is typically mounted above a T-fitting or pumping tee cross at the top of the tubing. The stuffing box provides a dynamic seal along the length of the polish rod. The stuffing box typically has a central passage through which the polish rod moves, while stuffing or packing material is compressed against the sides of the polish rod to create a fluid seal. The packing materials are typically elastomers and other materials which are softer than the polish rod material.

The movement of the polish rod within the packing material generates friction, and thus heat, which breaks down and degrades the packing materials contained within the stuffing box. This breakdown and degradation reduces the integrity of the seal formed between the packing material and the polish rod. The presence of solids in the produced fluid, such as sand, can accelerate this degrading of the packing material and can adversely impact the life of the polish rod, potentially resulting in a polish rod failure. The loss of the integrity of the seal between the polish rod and the packing material will result in the escape of fluids from the well which can result in environmental damage and the loss of valuable resources, and can result in significant clean-up expense and potential fines and penalties. Accelerated packing replacement also requires the expenditure of man-hours to replace the packing which might otherwise be avoided.

Solutions to the above problem typically focus on the packing material, such as utilizing a different type of packing material or attempting to reduce the friction between the polish rod and the packing material, and therefore reduce the thermal degradation.

SUMMARY OF THE INVENTION

Embodiments of the presently disclosed invention provides a solution to the problems identified above by addressing the problem by guiding and aligning the polish rod as it reciprocates within the stuffing box thereby reducing lateral motion of the polish rod. Embodiments of the invention may also wipe the polish rod of debris as it reciprocates within the device. In one embodiment of the invention, a coupling member, hereinafter referred to as the "centralizer" has threads on one end into which the threads of a pin end of the stuffing box are made up. The centralizer has a second end to which an alignment barrel depends, either by direct connection or by utilization of a barrel adapter. In a first embodiment of the invention, as the stuffing box is attached to the centralizer, the stuffing box is slid over a nylon sleeve through which the polish rod is inserted. In a second embodiment of the invention, the stuffing box is made up to the centralizer and the nylon sleeve is captured on the bottom side of the centralizer by the barrel adapter. In both embodiments, an alignment barrel depends from the centralizer, either by direct connection to the centralizer or by utilization of the barrel adapter, which makes up into the bottom of the centralizer.

The polish rod reciprocates within the alignment barrel and the nylon sleeve. The alignment barrel may comprise slots to allow for the passage of oil, scale and solids which may accumulate on the polish rod. The alignment barrel has an inside diameter which is smaller than the outside diameter of the coupling which attaches the polish rod to the top rod of the rod string, such that should the alignment barrel become detached from the centralizer, the alignment barrel can fall through the tubing no further than down to the connection between the polish rod and the top rod of the rod string.

DETAILED DESCRIPTION OF THE EMBODIMENTS

Figure 1:
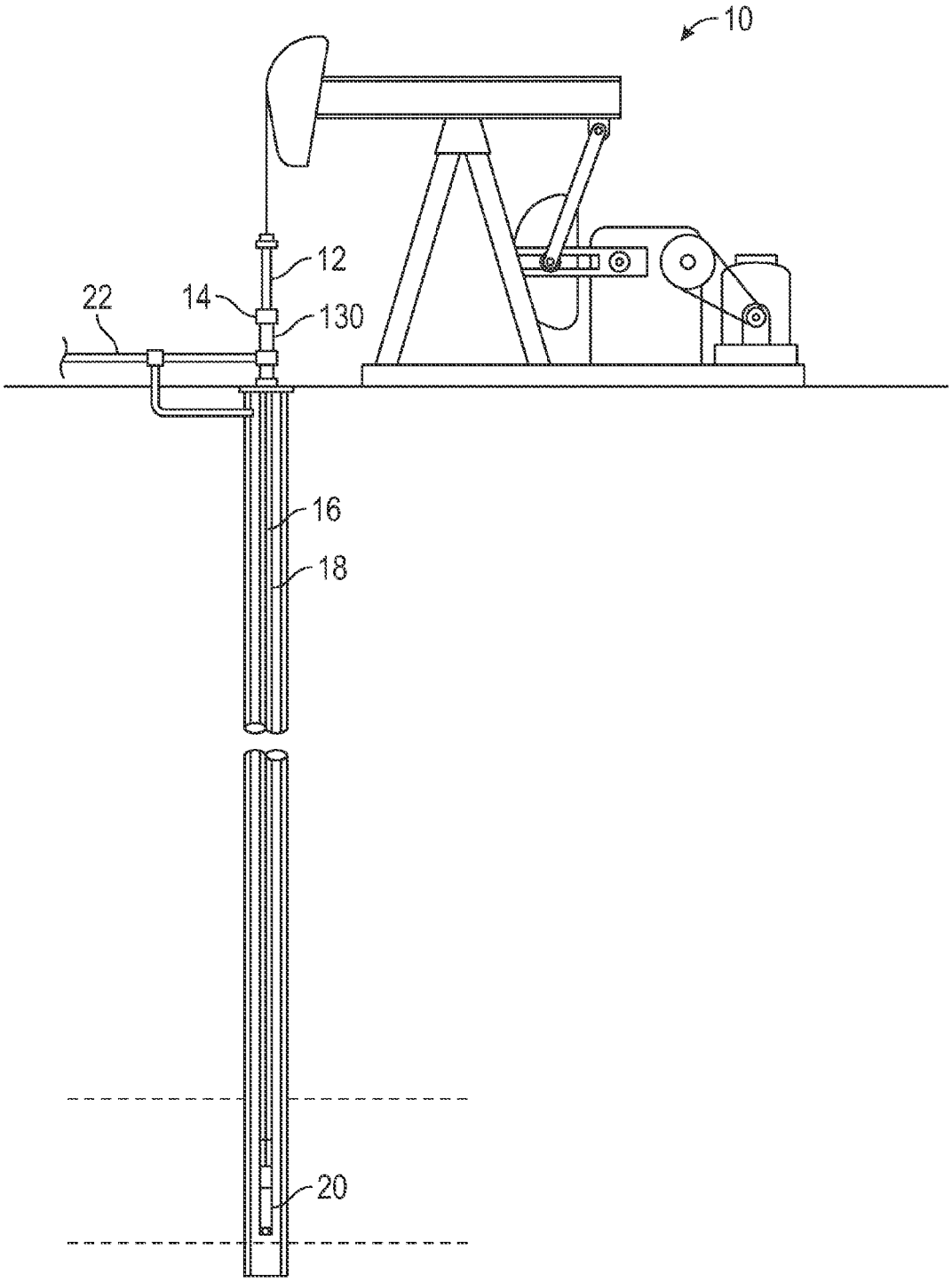
FIG. 1 shows a pump jack, polish rod, and stuffing box, to which embodiments of the present invention may be utilized.

Referring now to the figures, FIG. 1 shows a known pumping unit 10 which is utilized to impart a reciprocating motion to a rod string 16. The rod string terminates at the surface with a polish rod 12. As shown in greater detail in FIGS. 2, 2A and 2B, polish rod 12 reciprocates or rotates within stuffing box 14 which contains internal seal packing elements 26 for maintaining a pressure seal around the polish rod 12. Referring again to FIG. 1, rod string 16 reciprocates within a tubing string 18. A subsurface pump 20 is actuated by the reciprocal motion of the rod string 16 resulting in fluid flow from the reservoir up through the tubing string 18 and out production line 22 which is typically connected to an outlet of a pumping tee 24.

Stuffing box 14 maintains a seal between the polish rod 12 and the tubing string 18. An embodiment of an apparatus for maintaining the alignment of the polish rod with respect to the stuffing box 14, referred to hereinafter as the alignment device 100, forms an extended chamber for travel of the polish rod 12.

FIG. 1 schematically depicts one location in which the alignment device 100 may be mounted, where the centralizer 130 is depicted connected to the stuffing box 14. It is to be appreciated that most of the disclosed apparatus is not shown in FIG. 1, because, for this particular embodiment of the alignment device 100, with the exception of the centralizer 130, most of the device is contained within the pumping tee 24 and the top joint of the tubing string 18, and/or any pup joints between the pumping tee and the top joint. Embodiments of the present invention thus provide a guidance mechanism for the polish rod 12 which is almost entirely contained within the upper portion of the tubing string 18.

Figure 2:
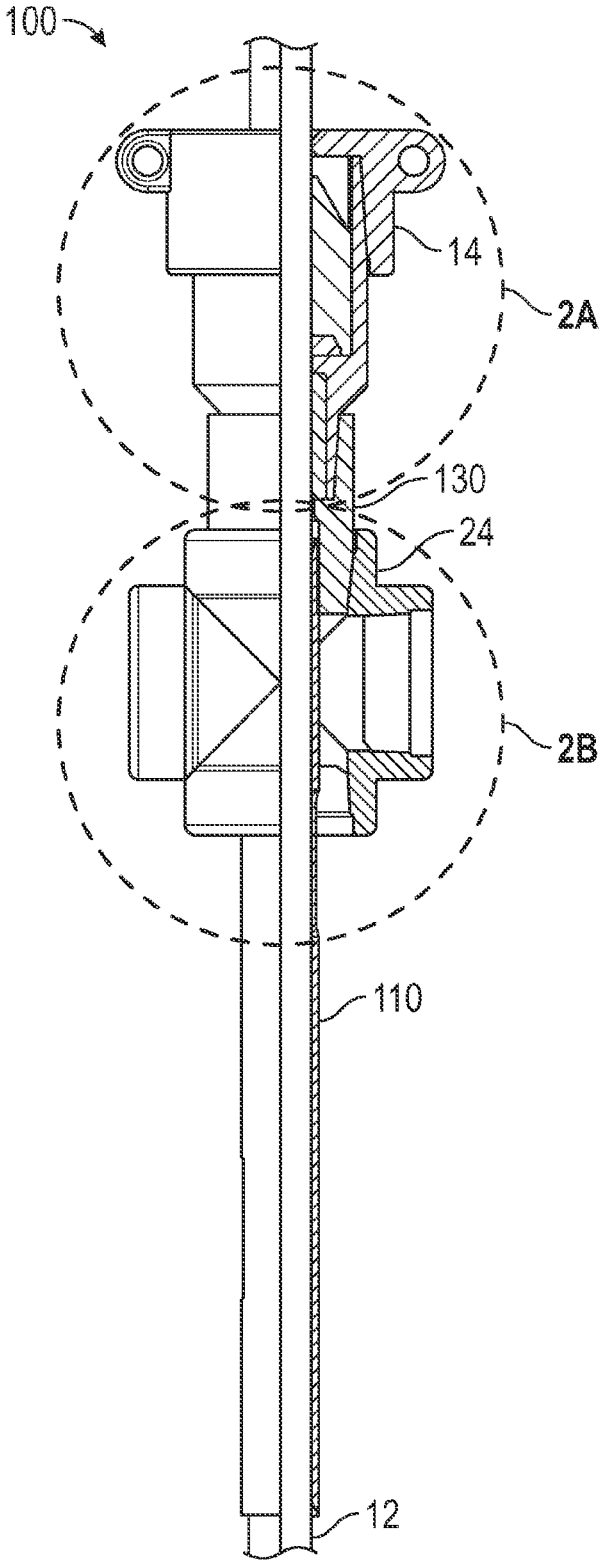
FIG. 2 shows a perspective view of an embodiment of the polish rod alignment device with a stuffing box attached.
Figure 2A:
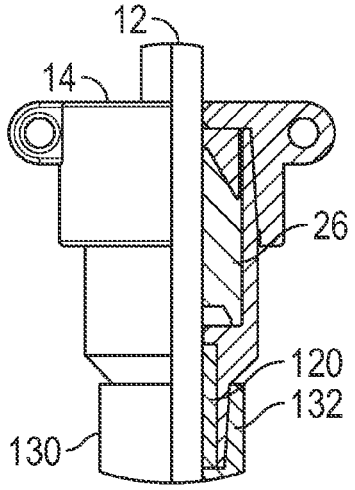
FIG. 2A shows a detailed view of the stuffing box attached to the preserver barrel coupling.
Figure 2B:
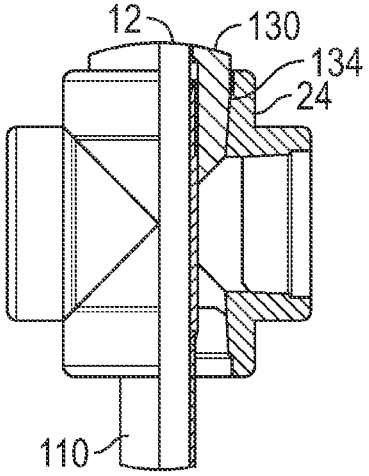
FIG. 2B shows a detailed view of the polish rod and preserver barrel extending through a pumping tee fitting.
Figure 3:
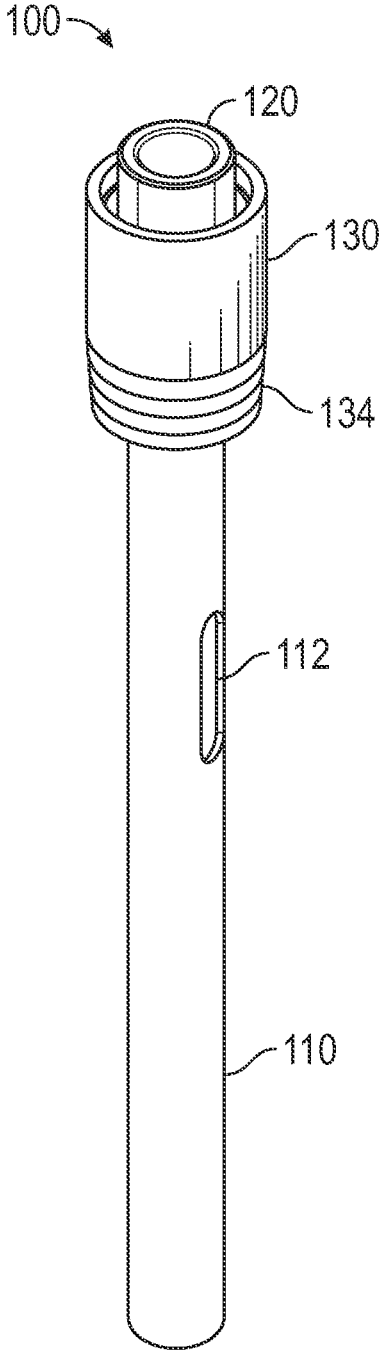
FIG. 3 shows a perspective view of an embodiment of the polish rod alignment device.
Figure 3A:
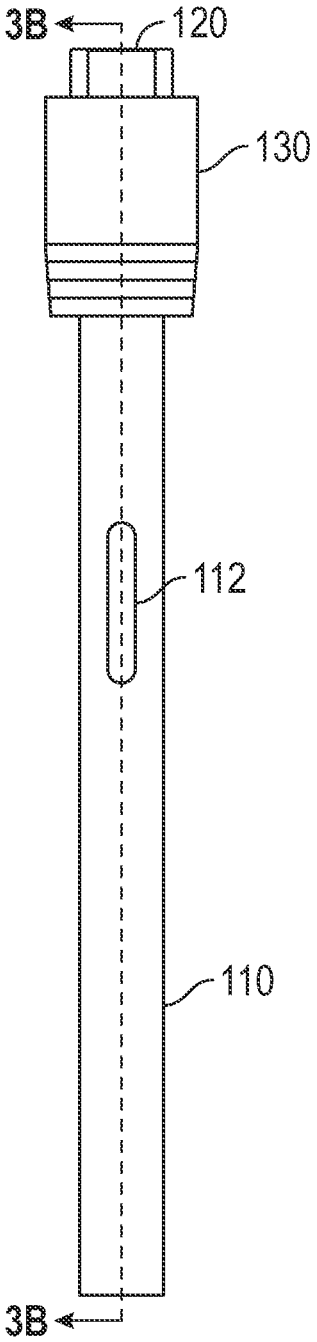
FIG. 3A shows a front view of an embodiment of the polish rod alignment device.
Figure 3B:
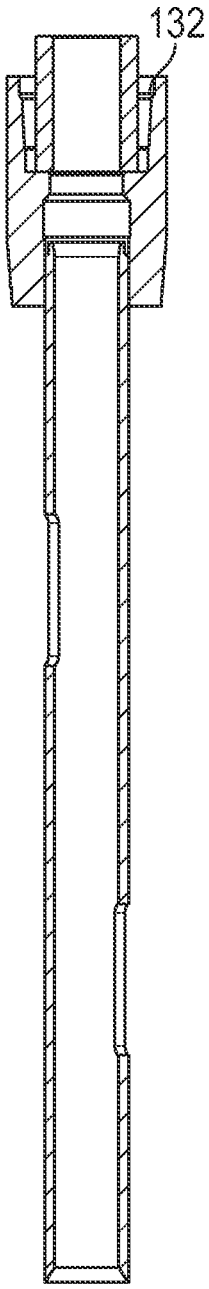
FIG. 3B shows a sectional view taken along line A-A of FIG. 3A.
Figure 3C:
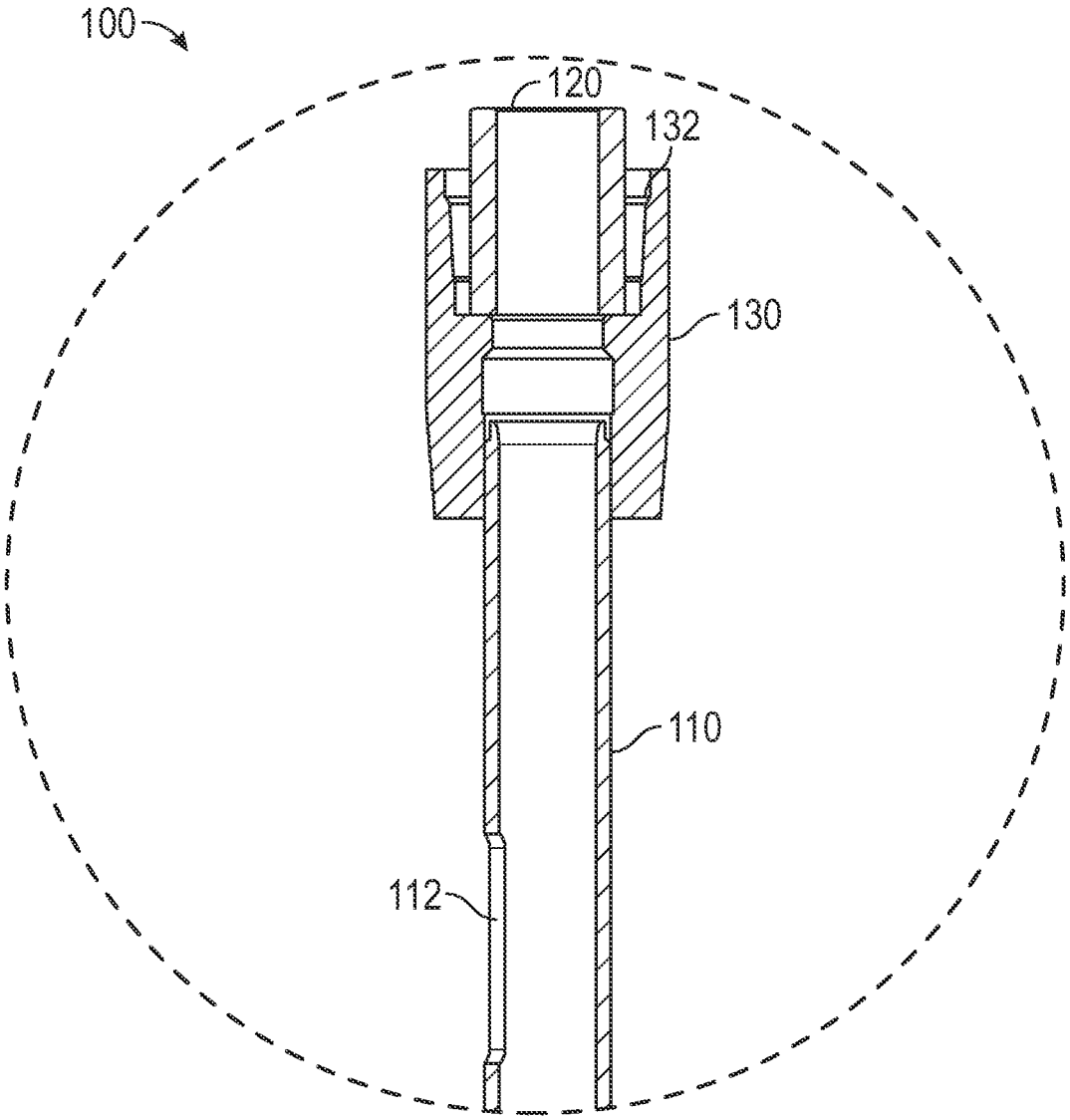
FIG. 3C shows a close-up view of circled portion of FIG. 3B.
Figure 4:
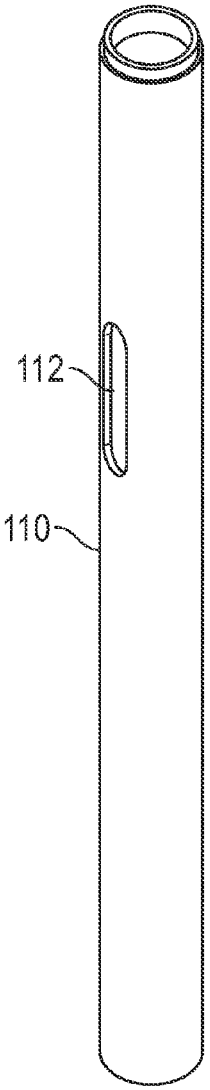
FIG. 4 shows a perspective view of an embodiment of an alignment barrel which may be utilized in embodiments of the polish rod alignment device.
Figure 4A:
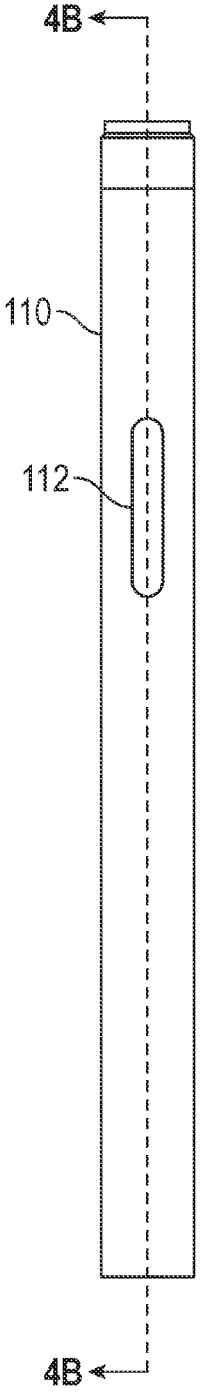
FIG. 4A shows a front view of an embodiment of an alignment barrel.
Figure 4B:
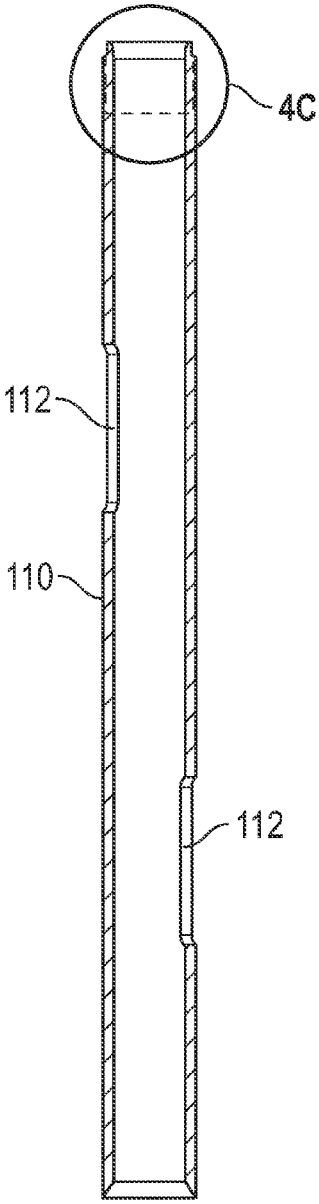
FIG. 4B shows a sectional view taken along line A-A of FIG. 4A.
Figure 4C:
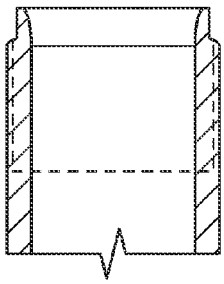
FIG. 4C shows a close up view of the circled portion of FIG. 4B. Illustrative dimensions are provided for one embodiment of the invention.
Figure 5:
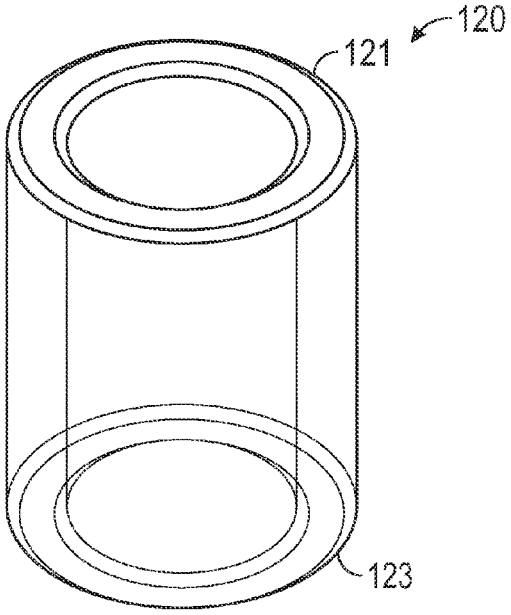
FIG. 5 shows a perspective view of an embodiment of a nylon sleeve which may be utilized in embodiments of the polish rod alignment device. Illustrative dimensions are provided for one embodiment of the invention.
Figure 5A:
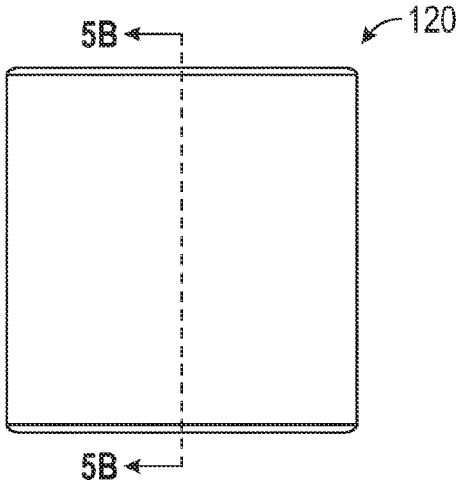
FIG. 5A shows a front view of an embodiment of the nylon sleeve.
Figure 5B:
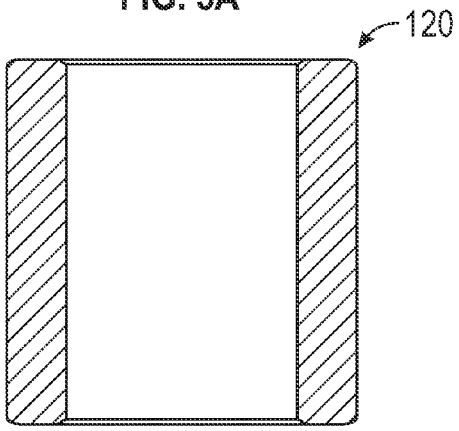
FIG. 5B shows a sectional view taken along line A-A of FIG. 5A. Illustrative dimensions are provided for one embodiment of the invention.
Figure 6:
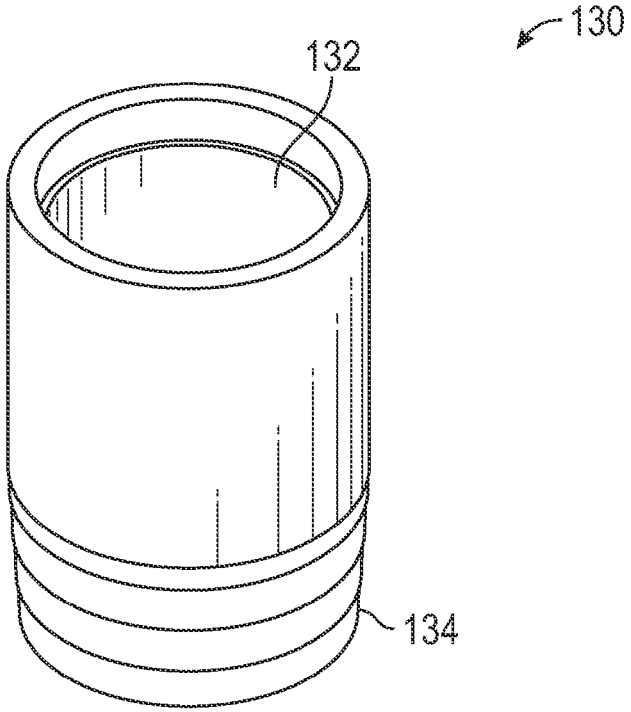
FIG. 6 is a perspective view of an embodiment of a coupling, i.e., centralizer, which may be utilized in embodiments of the polish rod alignment device.
Figure 6A:
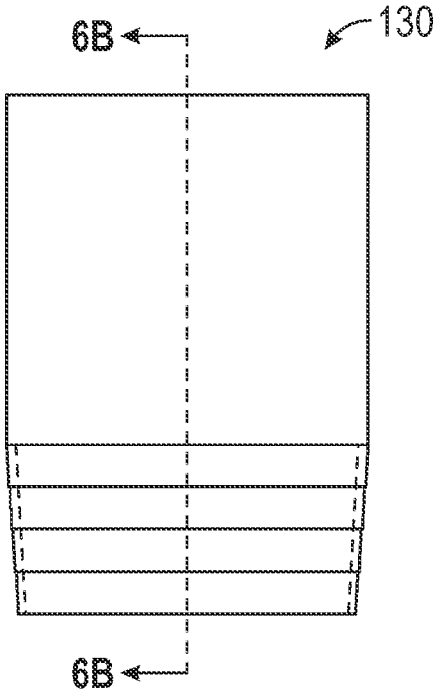
FIG. 6A shows a front view of an embodiment of a centralizer.
Figure 6B:
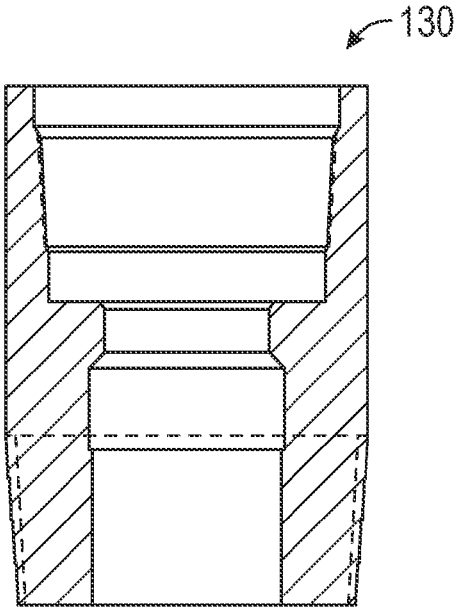
FIG. 6B shows a sectional view taken along line A-B of FIG. 6A.
Figure 7:
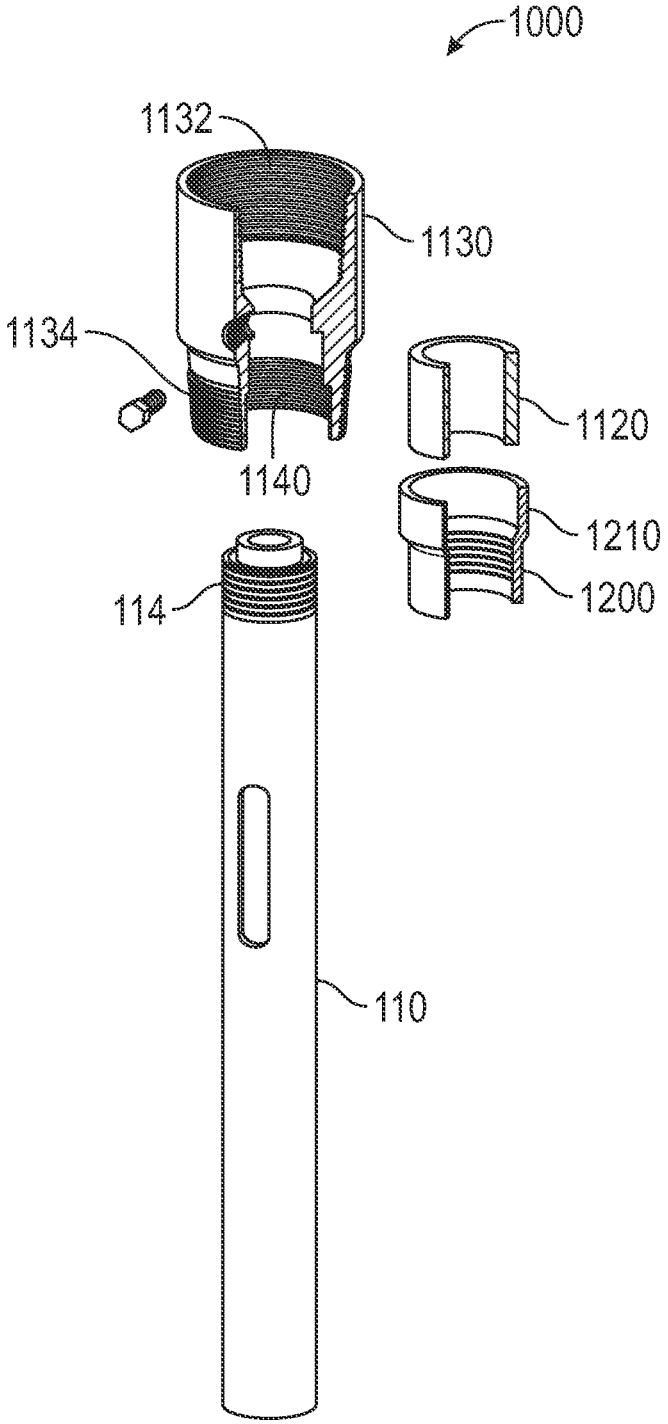
FIG. 7 shows an exploded and sectional view of an alternative embodiment of the polish rod alignment and stabilization device
Figure 8:
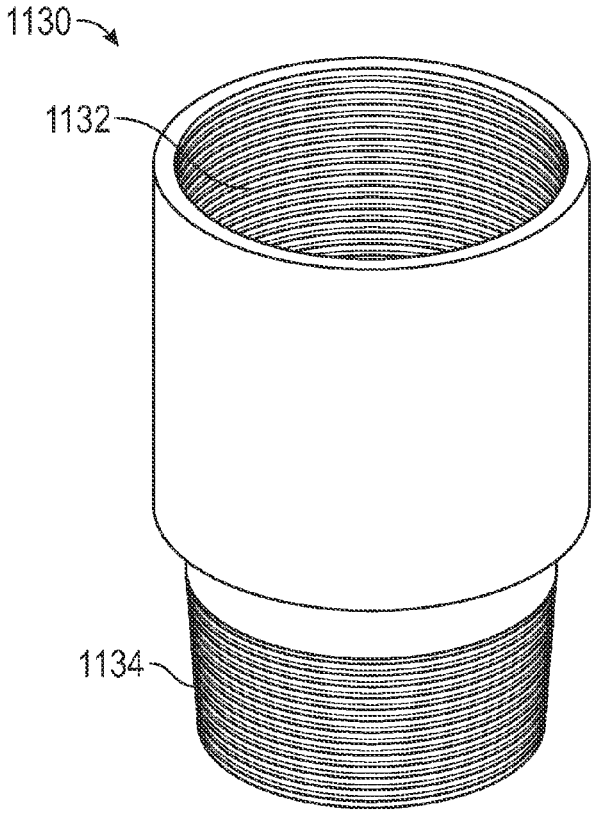
FIG. 8 shows a perspective view of a centralizer which may be used with the alternative embodiment.
Figure 9:
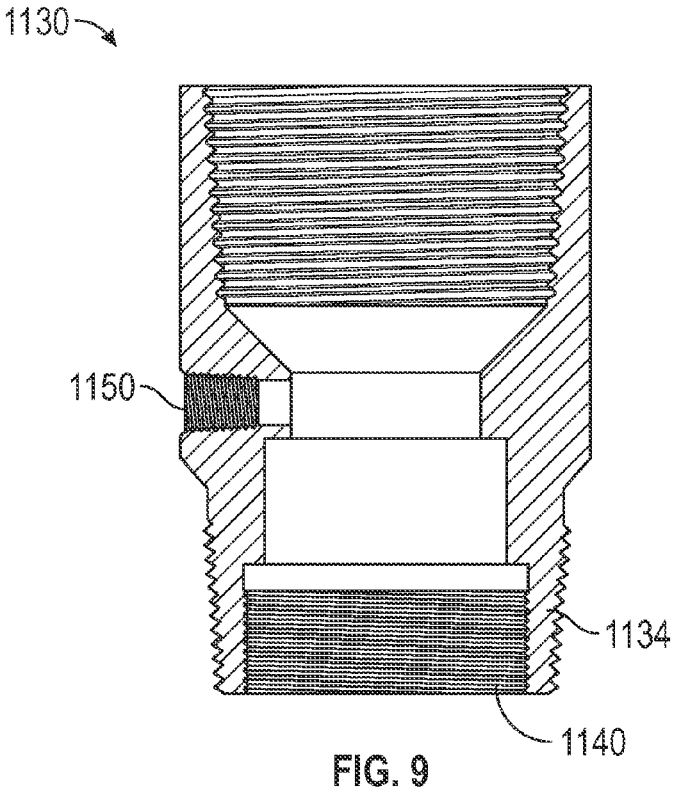
FIG. 9 shows a sectioned view of the centralizer of depicted in FIG. 8.
Figure 10:
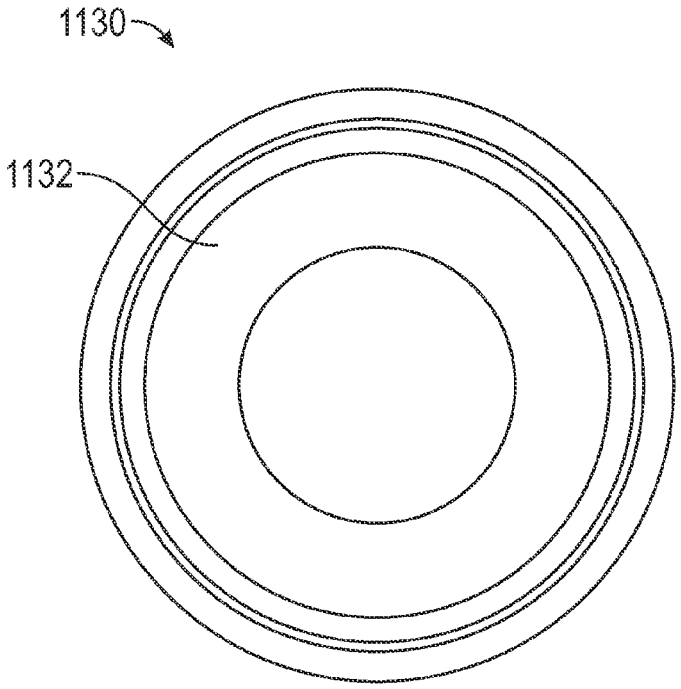
FIG. 10 shows a top view of the centralizer depicted in FIG. 8.
Figure 11:
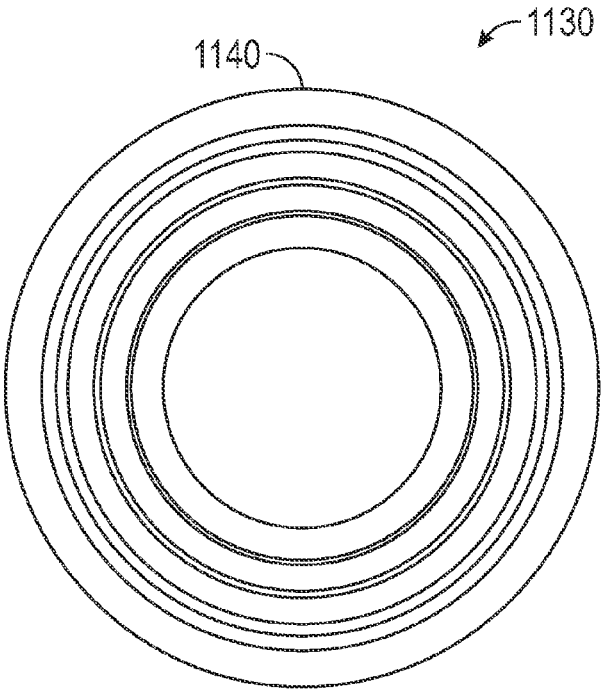
FIG. 11 shows a bottom view of the centralizer depicted in FIG. 8.

An embodiment of the alignment device 100 is generally depicted in FIGS. 2, 2A and 2B. In general, the alignment device 100 has an alignment barrel 110, an alignment sleeve 120, and a centralizer 130 to which the stuffing box 14 is attached. As shown in the Figures, the alignment device 100 may be configured with the centralizer 130 mounted at the top of the alignment barrel 110, with the alignment sleeve 120 disposed within the centralizer 130. For purposes of this disclosure, the terms "top," "bottom," "upper," "lower," "above," and "beneath" are made with reference to the ground surface, with items referred as top, upper, and above located at a higher relative position with respect to the ground surface than items referred to as bottom, lower, and beneath. For the embodiment of the alignment device 100 shown in FIGS. 2 and 2A, a pin or threaded end on the lower end of stuffing box 14 makes up into internal threads 132 in centralizer 130.

As shown in greater detail in FIGS. 2 and 2B, in this embodiment of the invention, the alignment barrel 110 is suspended from centralizer 130 such as by making up external threads on alignment barrel up into internal threads in centralizer 130, or by utilizing a hanger assembly on alignment barrel 110 which lands within a profile in centralizer 130. Centralizer 130 is attached to pumping tee 24 with the lower threads 134 of the centralizer 130 typically making up into internal threads contained within the production tee 24. The packing material 26 of the stuffing box 14 will typically be contained within a portion of the stuffing box 14 which is above the alignment sleeve 120. With this configuration, the polish rod 12 is isolated from the internal pressure of the tubing string 18 by the packing contained 26 within the stuffing box 14. In this embodiment of the alignment device 100, alignment sleeve 120, as shown in FIG. 2A, is vertically adjacent to the packing material 26. Alignment sleeve 120 centralizes and guides the polish rod 12 as it is reciprocated up and down inside the packing material 26.

For illustration purposes, in one embodiment of the invention, alignment sleeve 120 may have a length of approximately 3 inches and an inside diameter of approximately 1.5 inches, although the outside diameter of the alignment sleeve 120 is dependent upon the bottom inside diameter of the stuffing box or blow-out preventer into which upper edge 121 seats. The outside diameter of the alignment sleeve 120 must also fit into the top of the centralizer and mate to the designated face. For this reason, the alignment sleeve 120 may have a chamfered bottom edge 123 which seats within a corresponding chamfered portion of the centralizer 130, such that the faces are aligned and mated within the centralizer. Alignment sleeve 120 may be fabricated from nylon.

Alignment barrel 110, which may be fabricated from carbon steel or appropriate corrosion resistant materials and, in one embodiment, have an inside diameter of approximately 1.6 inches. The length L of alignment barrel 110 will be somewhat dependent upon the stroke length of the downhole pump 20. However, alignment barrel 110 will generally have a length greater than one foot, and may be several feet in length or longer. Thus, support and guidance for the polish rod 12 is provided for a significant distance adjacent to the stuffing box 14.

In most embodiments of the invention the outside diameter of the coupling which connects the top rod of rod string 16 to the bottom of polish rod 12 will be larger than the inside diameter of the alignment barrel 110, so the pump must be spaced such that the coupling is not pulled up into the bottom of the alignment barrel. This feature prevents the alignment barrel 110 from falling to the bottom of the tubing string 18 should the alignment barrel become detached from the centralizer 130, but rather the alignment barrel will be stopped by the coupling which connects the top rod of rod string 16 to the bottom of polish rod 12, such that the alignment barrel is relatively easy to recover in such situations.

As shown in the figures, alignment barrel 110 has slots 112 penetrating through its side walls which allow liquids, as well as any scale, solids, etc., which are produced up through the tubing to exit the alignment barrel 110. By way of example only, slots 112 may have a width of 0.625 inches and a length of approximately 3 inches and may be identical on either side of the barrel.

FIGS. 7 through 16 show an alternative embodiment of the alignment device 1000. This embodiment utilizes the same alignment barrel 110 as the embodiment of the alignment device 100 discussed above. Stuffing box 14 will make up into threads 1132 of the centralizer 1130. In the alternative embodiment of the alignment device 1000, a barrel adapter 1200 is utilized to attach the alignment barrel 110 to the centralizer 1130, where alignment sleeve 1120 is captured in the lower portion of centralizer 1130 by the engagement of threads 1210 of the barrel adapter 1200 to internal threads 1140 of the centralizer. Centralizer 1130 further comprises external threads 1134 at the bottom which make up into internal threads of the pumping tee 24 as before. Centralizer 1130 may further comprise a relief port 1150.

Figure 12:
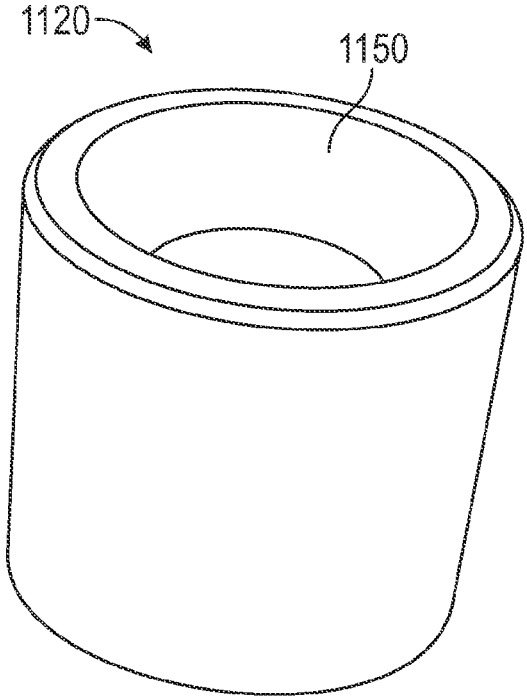
FIG. 12 shows a perspective view of a nylon sleeve which may be used with the alternative embodiment of the invention.
Figure 13:
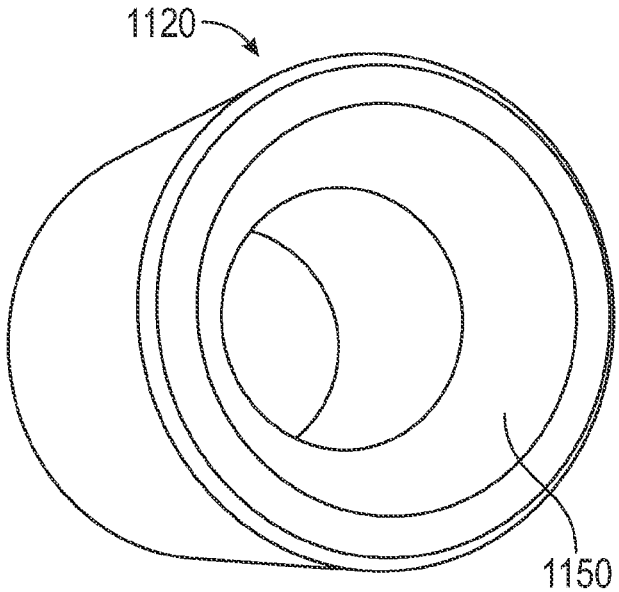
FIG. 13 shows a top perspective view of the nylon sleeve depicted in FIG. 12.
Figure 14:
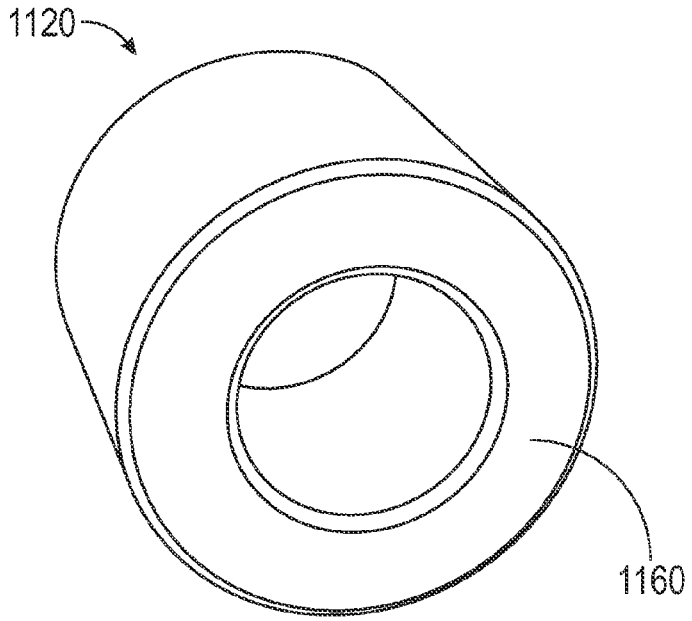
FIG. 14 shows a bottom perspective view of the nylon sleeve depicted in FIG. 12.

FIGS. 12 through 14 depict an embodiment of an alignment sleeve 1120 which might be utilized with the alternative embodiment of the alignment device 1000. The upper surface 1150 of alignment sleeve 1120 may be tapered to seal against an internal profile within the centralizer 1130. The lower surface 1160 may seal against a matching surface 1220 in barrel adapter 1200.

Figure 15:
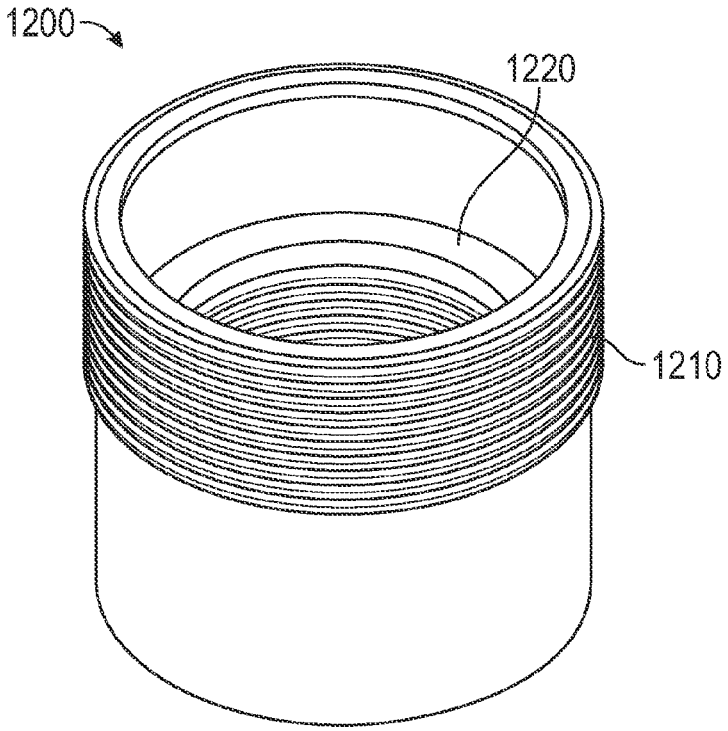
FIG. 15 shows a perspective view of a barrel adapter which may be used with the alternative embodiment of the invention.
Figure 16:
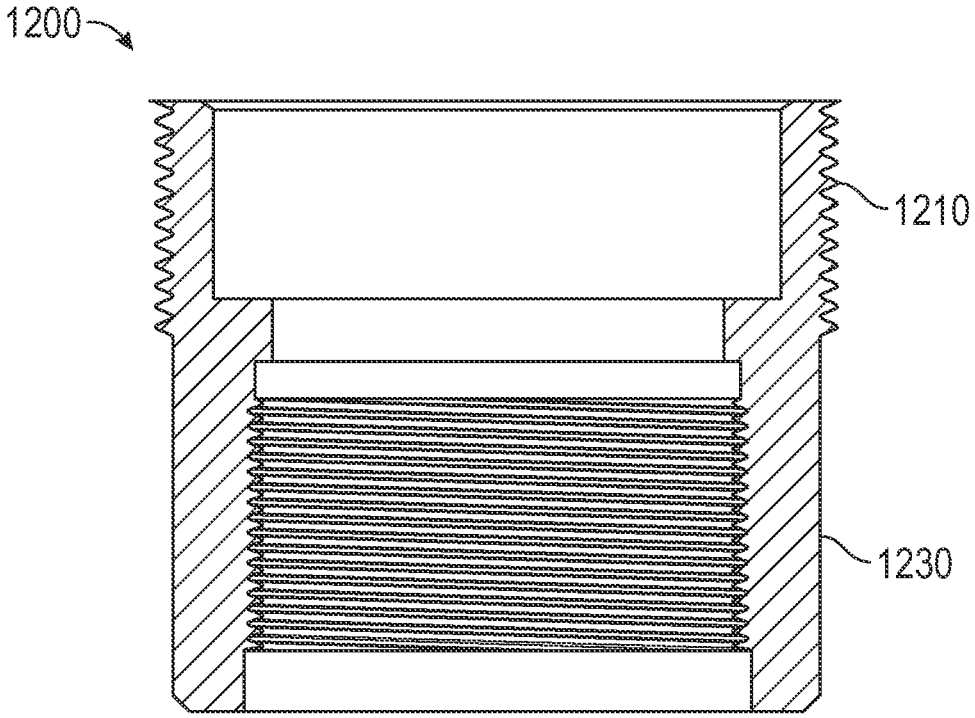
FIG. 16 shows a sectioned view of the barrel adapter depicted in FIG. 15.

FIGS. 15 through 16 depict an embodiment of a barrel adapter 1200 which may be utilized to attach alignment barrel 110 to centralizer 1130 in an embodiment of the alignment device 1000, such that alignment barrel 110 depends from centralizer 1130, capturing alignment sleeve 1120 between the centralizer and the barrel adapter. Barrel adapter 1200 comprises external threads 1210 which make up into threads 1140 of the centralizer. Barrel adapter 1200 may further comprise threads 1230 which make up to threads 114 of alignment barrel 110.

This embodiment of the alignment device 1000 allows manufacturing of a single centralizer body 1130 which may be utilized with three sizes of barrel adapter 1200, such that embodiments of the device may accommodate three sizes of polish rod, specifically 1.25", 1.50", and 1.75".

While the above is a description of various embodiments of the present invention, further modifications may be employed without departing from the spirit and scope of the present invention. Thus the scope of the invention should not be limited according to these factors, but according to the following appended claims.

What is claimed is:

1. In an oilwell produced by a downhole pump operated by the reciprocation of a string of rods disposed within a string of tubing, wherein a top rod of the rod string is attached to a polish rod which reciprocates within a stuffing box, the stuffing box having a plurality of internal packing elements, an apparatus operating in combination with an uppermost joint of the tubing string for maintaining the alignment of the polish rod with respect to the stuffing box comprises:

a centralizer having a first end and a second end, the first end for receiving an end connection of the stuffing box;

an alignment barrel comprising an outer circumferential surface and an inner bore extending axially therethrough which depends from the centralizer, wherein a portion of the alignment barrel is disposed within the uppermost joint of the tubing string, and wherein the alignment barrel comprises at least one slot extending axially along and radially through the alignment barrel allowing fluid flow between the inner bore and the outer circumferential surface; and a sleeve member fabricated from a material softer than the polish rod, the sleeve member partially contained within the centralizer, wherein the polish rod reciprocates within the sleeve member and within the plurality of internal packing elements of the stuffing box.

2. The apparatus of claim 1 wherein the sleeve member is fabricated from nylon.

3. The apparatus of claim 1 wherein the alignment barrel is attached to the second end of the centralizer.

4. The apparatus of claim 1 wherein the sleeve member comprises a top surface and a bottom surface, and the top surface is disposed within the stuffing box and the bottom surface is disposed against an upward facing seating surface within the centralizer.

5. The apparatus of claim 1 further comprising a barrel adapter disposed between the centralizer and the alignment barrel, the barrel adapter comprising an upper end and a lower end.

6. The apparatus of claim 5 wherein the upper end of the barrel adapter is attached to the second end of the centralizer and the alignment barrel is attached to the lower end of the barrel adapter.

7. The apparatus of claim 6 wherein the sleeve member comprises a top surface and a bottom surface, and the top surface is disposed against a downward facing seating surface within the centralizer and the bottom surface is disposed within the barrel adapter.

8. In an oil well produced by a downhole pump operated by the reciprocation of a string of rods disposed within a string of tubing, wherein a top rod of the rod string is attached to a polish rod which reciprocates within a stuffing box, the stuffing box having a plurality of internal packing elements, an apparatus operating in combination with an uppermost joint of the tubing string for maintaining the alignment of the polish rod with respect to the stuffing box comprises:

a centralizer having a first end and a second end, the first end for receiving an end connection of the stuffing box;

an alignment barrel comprising an outer circumferential surface and an inner bore extending axially therethrough attached to the centralizer, wherein a portion of the alignment barrel is disposed within the upmost uppermost joint of the tubing string, and wherein the alignment barrel comprises at least one slot extending axially along and radially through the alignment barrel allowing fluid flow between the inner bore and the outer circumferential surface; and a sleeve member partially contained within the centralizer, the sleeve member fabricated from a material softer than the polish rod, the sleeve member comprising a top surface and bottom surface, and the top surface is disposed within the stuffing box and the bottom surface is disposed against an upward facing seating surface within the centralizer, wherein the polish rod reciprocates within the sleeve member and the plurality of internal packing elements of the stuffing box.

9. The apparatus of claim 8 wherein the sleeve member comprises nylon.

10. In an oil well produced by a downhole pump operated by the reciprocation of a string of rods disposed within a string of tubing, wherein a top rod of the rod string is attached to a polish rod which reciprocates within a stuffing box, the stuffing box having a plurality of internal packing elements, an apparatus operating in combination with an uppermost joint of the tubing string for maintaining the alignment of the polish rod with respect to the stuffing box comprises:

a centralizer having a first end and a second end, the first end for receiving an end connection of the stuffing box;

a barrel adapter attached to the second end of the centralizer, the barrel adapter comprising an upper set of threads made up to the second end of the centralizer and a lower set of threads;

an alignment barrel comprising an outer circumferential surface and an inner bore extending axially therethrough made up to the lower set of threads of the barrel adapter wherein a portion of the alignment barrel is disposed within the uppermost joint of the tubing string, and wherein the alignment barrel comprises at least one slot extending axially along and radially through the alignment barrel allowing fluid flow between the inner bore and the outer circumferential surface; and a sleeve member is partially contained within the centralizer, the sleeve member comprising a material softer than the polish rod, wherein the polish rod reciprocates within the sleeve member and within the plurality of internal packing elements of the stuffing box.

11. The apparatus of claim 10 wherein the sleeve member comprises a top surface and a bottom surface, and the top surface is disposed against a downward facing seating surface within the centralizer and the bottom surface is disposed within the barrel adapter.

* * * * *